US012173637B2

(12) United States Patent
Christensen et al.

(10) Patent No.: US 12,173,637 B2
(45) Date of Patent: Dec. 24, 2024

(54) EXHAUST SYSTEM HEAT SINK FOR INCREASING EFFICIENCY OF INTERNAL COMBUSTION ENGINES

(71) Applicant: NPower LLC, Lehi, UT (US)

(72) Inventors: Jarom Christensen, Lehi, UT (US); Alexander J. Sorensen, Tremonton, UT (US)

( * ) Notice: Subject to any disclaimer, the term of this patent is extended or adjusted under 35 U.S.C. 154(b) by 0 days.

(21) Appl. No.: 18/336,986

(22) Filed: Jun. 17, 2023

(65) Prior Publication Data

US 2023/0332530 A1 Oct. 19, 2023

Related U.S. Application Data

(63) Continuation-in-part of application No. PCT/US2021/072997, filed on Dec. 17, 2021.

(60) Provisional application No. 63/126,973, filed on Dec. 17, 2020.

(51) Int. Cl.

| | |
|---|---|
| ***F01N 5/02*** | (2006.01) |
| ***F01N 3/02*** | (2006.01) |
| ***F01N 13/10*** | (2010.01) |
| ***F28F 1/20*** | (2006.01) |

(52) U.S. Cl.

CPC ..... *F01N 5/025* (2013.01); *F01N 3/0205* (2013.01); *F01N 13/10* (2013.01); *F28F 1/20* (2013.01); *F01N 2240/02* (2013.01); *F01N 2450/18* (2013.01); *F28F 2275/08* (2013.01)

(58) Field of Classification Search

CPC ..... F01N 3/0205; F01N 5/025; F01N 13/10; F01N 2240/02; F01N 2450/18; F28F 1/20; F28F 2275/08

See application file for complete search history.

(56) References Cited

U.S. PATENT DOCUMENTS

| | | | |
|---|---|---|---|
| 3,477,227 | A | 3/1968 | Bettega et al. |
| 4,095,998 | A | 6/1978 | Hanson |
| 4,673,863 | A | 6/1987 | Swarbrick |
| 5,094,821 | A | 3/1992 | Hitachi et al. |
| 7,870,889 | B2 | 1/2011 | Zhou et al. |
| 2005/0217714 | A1 | 10/2005 | Nishijima et al. |
| 2007/0253202 | A1 | 11/2007 | Wu et al. |
| 2010/0043413 | A1 | 2/2010 | Orihashi et al. |
| 2016/0146083 | A1 | 5/2016 | Lang et al. |

FOREIGN PATENT DOCUMENTS

| | | | |
|---|---|---|---|
| CN | 102208885 | A | 10/2011 |
| CN | 103644016 | A | 3/2014 |
| CN | 105790638 | A | 7/2016 |
| CN | 110112958 | A | 8/2019 |

(Continued)

OTHER PUBLICATIONS

International Search Report and Written Opinion from counterpart Int'l Pat. App. PCT/US2021/072997, Feb. 22, 2022 (9 pp.).

*Primary Examiner* — Audrey B. Walter
(74) *Attorney, Agent, or Firm* — FisherBroyles, LLP

(57) ABSTRACT

A heat sink can be coupled to an exhaust pipe of an internal combustion engine to cool the exhaust gas and thereby increase the efficiency of the internal combustion engine. The heat sink can include a plurality of heat transfer projections extending outward from the exhaust pipe. The heat sink is a separate component that is coupled to the exterior of the exhaust pipe.

16 Claims, 5 Drawing Sheets

(56) References Cited

FOREIGN PATENT DOCUMENTS

| | | | |
|---|---|---|---|
| CN | 210033570 | U | 2/2020 |
| CN | 210241521 | U | 4/2020 |
| CN | 112803655 | A | 5/2021 |
| JP | 3637365 | B2 * | 4/2005 |
| KR | 1998-046909 | | 9/1998 |
| KR | 2013-0039149 | | 4/2013 |
| KR | 2013-0073411 | | 7/2013 |
| WO | WO 1989/004915 | | 6/1989 |

* cited by examiner

EXHAUST SYSTEM HEAT SINK FOR INCREASING EFFICIENCY OF INTERNAL COMBUSTION ENGINES

TECHNICAL FIELD

This relates to devices and methods that can be used to increase the efficiency of an internal combustion engine.

BACKGROUND

Most internal combustion engines are incredibly inefficient at turning fuel burned into usable energy. The efficiency by which they do so is measured in terms of "thermal efficiency," and most gasoline combustion engines average around 20 percent thermal efficiency. Diesels are typically higher—approaching 40 percent in some cases. It would be desirable to find ways to increase the efficiency of internal combustion engines.

GENERAL DESCRIPTION

A heat sink can be coupled to the exhaust pipe of an internal combustion engine to increase the thermal and/or fuel efficiency of the engine. The heat sink reduces the temperature of the exhaust (e.g., exhaust pipe or exhaust gas), which increases the overall temperature difference of the engine and increases the efficiency.

The efficiency of a Carnot cycle-based heat engine is defined as:

$$\in = T_{hot} - T_{cold} / T_{hot} \quad (1)$$

The equation shows that the efficiency of a Carnot cycle-based heat engine can be increased by increasing the difference between the combustion temperature and the exhaust temperature. The heat sink is used to reduce the temperature of the exhaust, which increases the efficiency of the engine.

In some embodiments, the heat sink includes: a first base plate having a cylindrical shape sized to fit around and contact an exterior surface of an exhaust pipe from an internal combustion engine; a second base plate having a cylindrical shape sized to fit around and contact the exterior surface of the exhaust pipe from the internal combustion engine; and heat transfer fins positioned directly on and extending radially outward from the first base plate and the second base plate, the heat transfer fins extending along the first base plate and the second base plate in a direction parallel to a lengthwise direction of the heat sink; wherein the first base plate and the second base plate form two halves configured to be releasably coupled around the exterior surface of the exhaust pipe; and wherein the heat sink is a passive heat exchanger configured to transfer heat from the exhaust pipe to ambient air.

In some embodiments, the heat sink includes: a first base plate having a cylindrical shape; a second base plate having a cylindrical shape; one or more thermoelectric generators positioned in contact with an interior surface of the first base plate and the second base plate, the one or more thermoelectric generators being configured to fit around and contact an exterior surface of an exhaust pipe from an internal combustion engine; and heat transfer fins positioned directly on and extending radially outward from the first base plate and the second base plate, the heat transfer fins extending along the first base plate and the second base plate in a direction parallel to a lengthwise direction of the heat sink; wherein the first base plate and the second base plate form two halves configured to be releasably coupled around the exterior surface of the exhaust pipe; and wherein the heat sink is a passive heat exchanger configured to transfer heat from the exhaust pipe to ambient air.

In some embodiments, the heat sink is a simple mechanical heat exchange device that does not have any electronic components. For example, the heat sink may be devoid of a thermoelectric generator and/or thermoelectric generation capability. As another example, the heat sink may be devoid of any semiconductors or semiconductor materials. In some embodiments, the heat sink is coupled to the exhaust system and has no moving parts when in use. In other embodiments, the heat sink can include electronic components such as a thermoelectric generator and/or thermoelectric generation capability.

In some embodiments, the heat sink is a passive heat exchanger that transfers heat from the exhaust to the ambient air. For example, the heat sink can have one or more components designed to enhance heat transfer from the exhaust to the ambient air. In some embodiments, the heat sink includes projections such as heat transfer fins or the like that increase the overall surface area thereby increasing convection heat transfer from the heat sink to the ambient air. In some embodiments, the heat sink does not include any active heat exchanger functionality and/or does not rely on a phase change of a material to store/transfer heat from the exhaust to the ambient air. In some embodiments, the heat sink relies only on passive heat exchange with the ambient air to transfer heat from the exhaust to the ambient air.

In some embodiments, the heat sink is coupled to an outer surface of the exhaust pipe or other component of the exhaust system and does not directly contact the exhaust gas. Heat is transferred by conduction through the wall of the exhaust pipe to the heat sink where it is transferred by convection to the ambient air. Configuring the heat sink so it does not directly contact the exhaust gas is advantageous because it reduces chemical corrosion and/or physical erosion of the heat sink. It also reduces the cost of the heat sink because it can have a less robust construction.

In some embodiments, the heat sink is a separate component that is coupled to the exhaust system. For example, the heat sink can be an add-on component that is coupled to the exterior of the exhaust pipe. In some embodiments, thermal compound can be positioned between the heat sink and the exhaust pipe.

In some embodiments, the heat sink is made of a material having a high degree of thermal conductivity. For example, the heat sink can be made of or include metal such as steel, steel alloys, aluminum, and/or aluminum alloys.

In some embodiments, the heat sink can be used with the internal combustion engine of a vehicle such as a car truck or other type of vehicle. For example, the heat sink can be used with the internal combustion engine of a semi-truck. Likewise, the heat sink can be used with the internal combustion of an automobile. The vehicles can operate using any type of fuel such as gasoline, diesel, or the like.

The general description is provided to give a general introduction to the described subject matter as well as a synopsis of some of the technological improvements and/or advantages it provides. The general description and background are not intended to identify essential aspects of the described subject matter, nor should they be used to constrict or limit the scope of the claims. For example, the scope of the claims should not be limited based on whether the recited subject matter includes any or all aspects noted in the general description and/or addresses any of the issues noted in the background.

DESCRIPTION OF DRAWINGS

The preferred and other embodiments are described in association with the accompanying drawings in which.

DETAILED DESCRIPTION OF EMBODIMENTS

Figure 1:
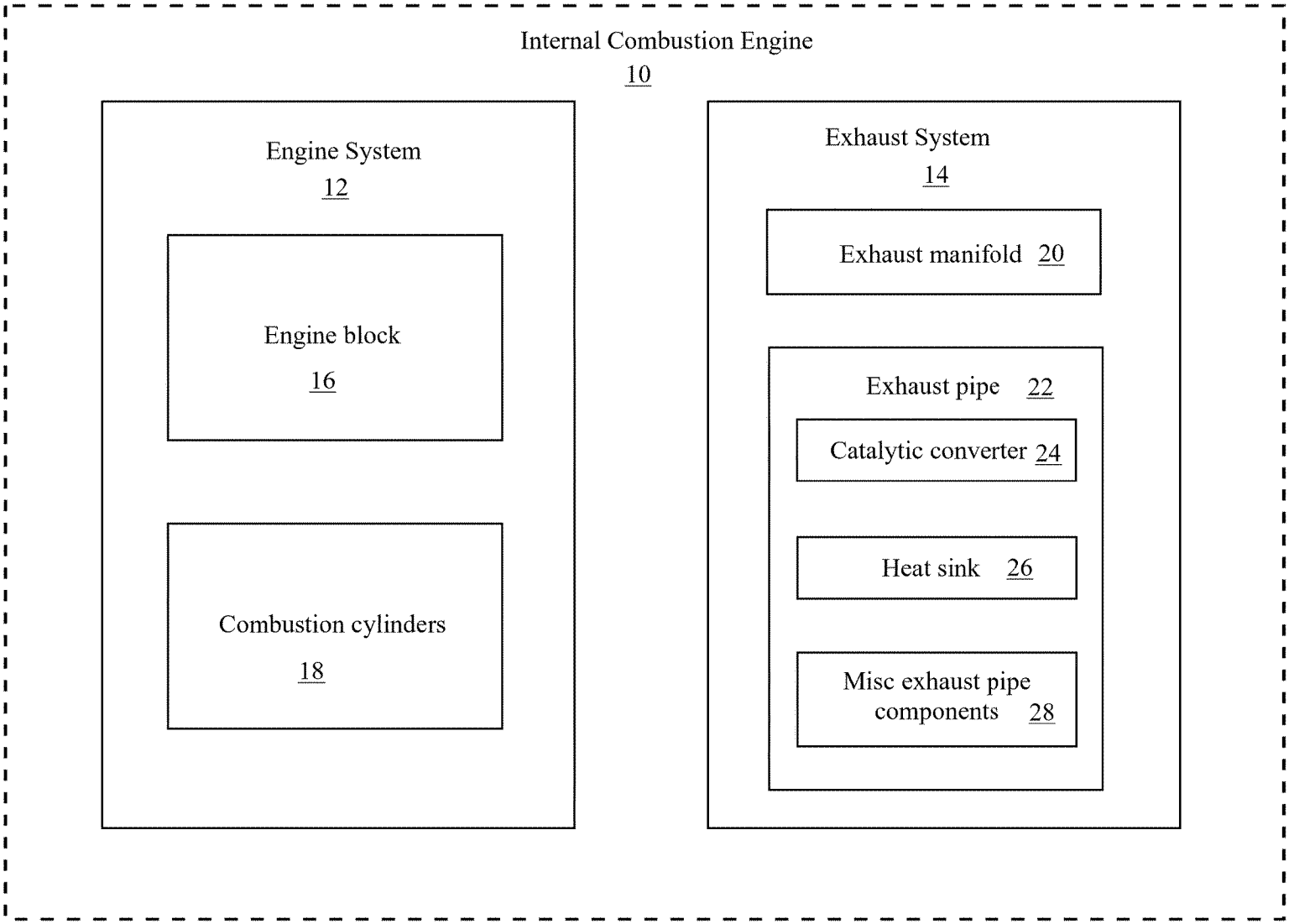
FIG. 1 is a block diagram of one embodiment of an internal combustion engine with a heat sink that increases fuel efficiency.

FIG. 1 is a block diagram of one embodiment of an internal combustion engine 10 including an engine system 12 and an exhaust system 14. The engine system 12 includes an engine block 16 and combustion cylinders 18. The exhaust system 14 is coupled to the engine system 12. For example, the exhaust system 14 can be coupled to the engine block 16 and fluidly linked to the combustion cylinders 18.

The exhaust system 14 includes an exhaust manifold 20 coupled to an exhaust pipe 22. The exhaust pipe 22 can include a catalytic converter 24 (e.g., catalytic reduction systems), a heat sink 26, and miscellaneous exhaust pipe components 28. The miscellaneous exhaust pipe components 28 can include a variety of exhaust components such as oxidation catalysts, particulate filters, mufflers, and/or resonators.

In some embodiments, the miscellaneous components 28 can include one or more of the following bellow pipes, oxygen sensors, muffler clamps and hangers, stainless steel exhaust pipes, various sized exhaust clamps, exhaust dividers, Y-pipes, expanders and reducers, flexible metal hosing, individual chrome or aluminized exhaust stacks, dump truck stacks, middle spools, rain caps, mounting brackets, tube repair sections, heat diverter boxes, spring plates, heat wrap, heat sleeves, mufflers and resonators, elbows, heat shields and exhaust shields, grab handles, and the like.

It should be appreciated that the exhaust pipe 22 can have any number of suitable configurations. For example, the components that form the exhaust pipe 22 can arranged in any desired order and more than one of each component can be present. In some embodiments, the heat sink 26 can be positioned after the catalytic converter 24. In other embodiments, the heat sink 26 can be positioned before the catalytic converter 24.

Figure 2:
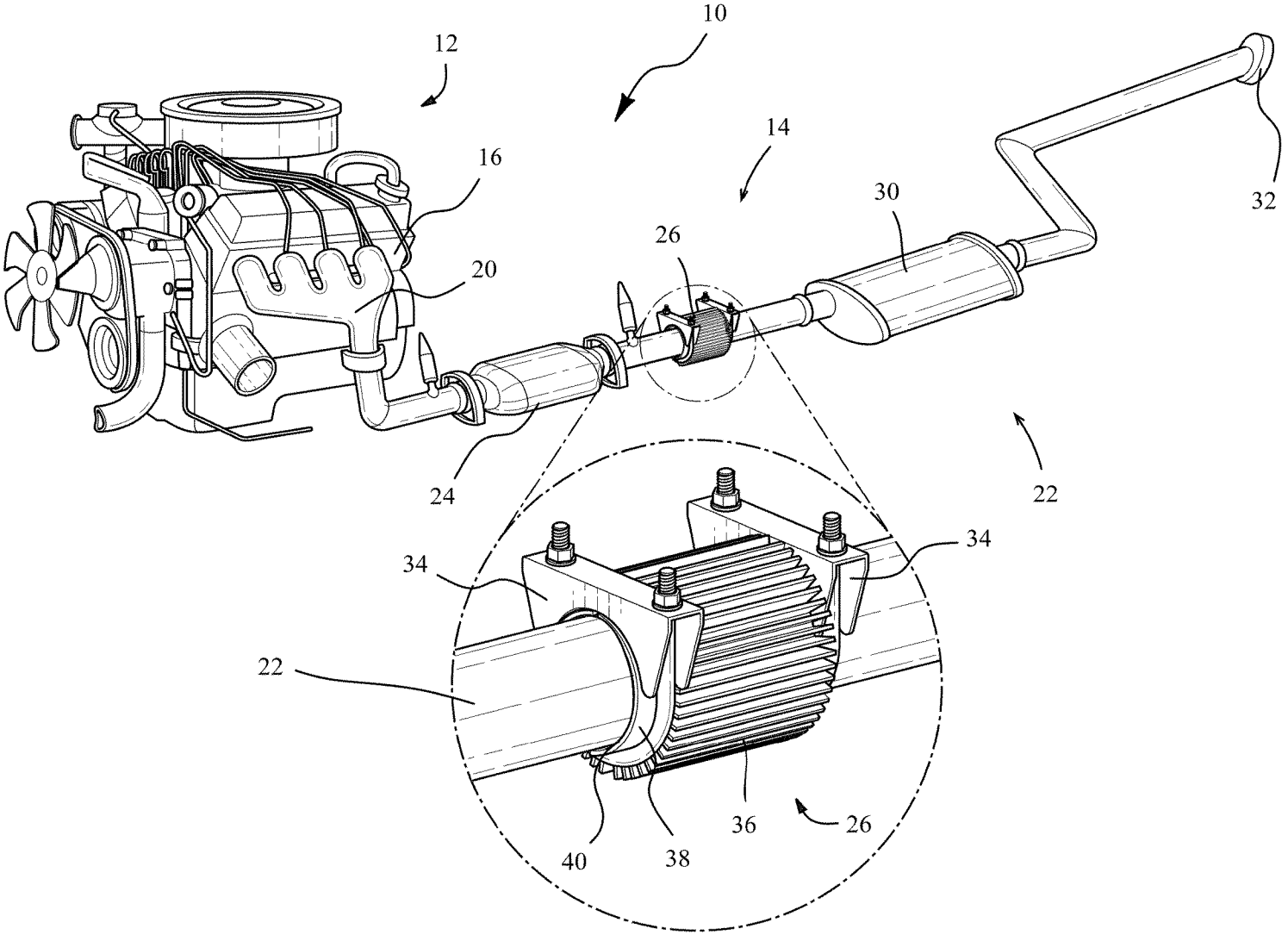
FIG. 2 is a perspective view of another embodiment of an internal combustion engine with a heat sink that increases fuel efficiency.

FIG. 2 is a perspective view of one embodiment of the internal combustion engine 10 including the engine system 12 and the exhaust system 14. The engine block 16 houses a plurality of combustion cylinders (not shown). The exhaust manifold 20 is coupled to the engine block 16 and fluidly linked to the combustion cylinders 18. The exhaust manifold 20 receives and collects exhaust gas from the combustion cylinders 18.

The exhaust manifold 20 is coupled to and fluidly linked with the exhaust pipe 22. The exhaust pipe 22 includes the catalytic converter 24, the heat sink 26, a muffler 30, and an exhaust outlet 32. The exhaust pipe 22 receives the exhaust gas from the exhaust manifold 20 and directs it through the various components and out the exhaust outlet 32.

The heat sink 26 is positioned after the catalytic converter 24 and before the muffler 30. It should be appreciated, however, that the exhaust pipe 22 can have any number of suitable configurations including any of those described above. A few such variations are described below. However, it should be understood that the components of the exhaust pipe 22 can be provided in any suitable order and/or combination.

In some embodiments, the heat sink 26 is positioned between the exhaust manifold 20 and the catalytic converter 24. In these embodiments, the heat sink 26 can be configured to cool the exhaust but not so much that it impairs operation of the catalytic converter 24. In some embodiments, the heat sink 26 is positioned at least 4 inches from the engine block 16 or the exhaust manifold 20, at least six inches from the engine block 16 or the exhaust manifold 20, or at least 8 inches from the engine block 16 or the exhaust manifold 20. Positioning the heat sink 26 a minimum distance from the engine block 16 or the exhaust manifold 20 helps to facilitate effective heat transfer and cooling of the exhaust.

Figure 3:
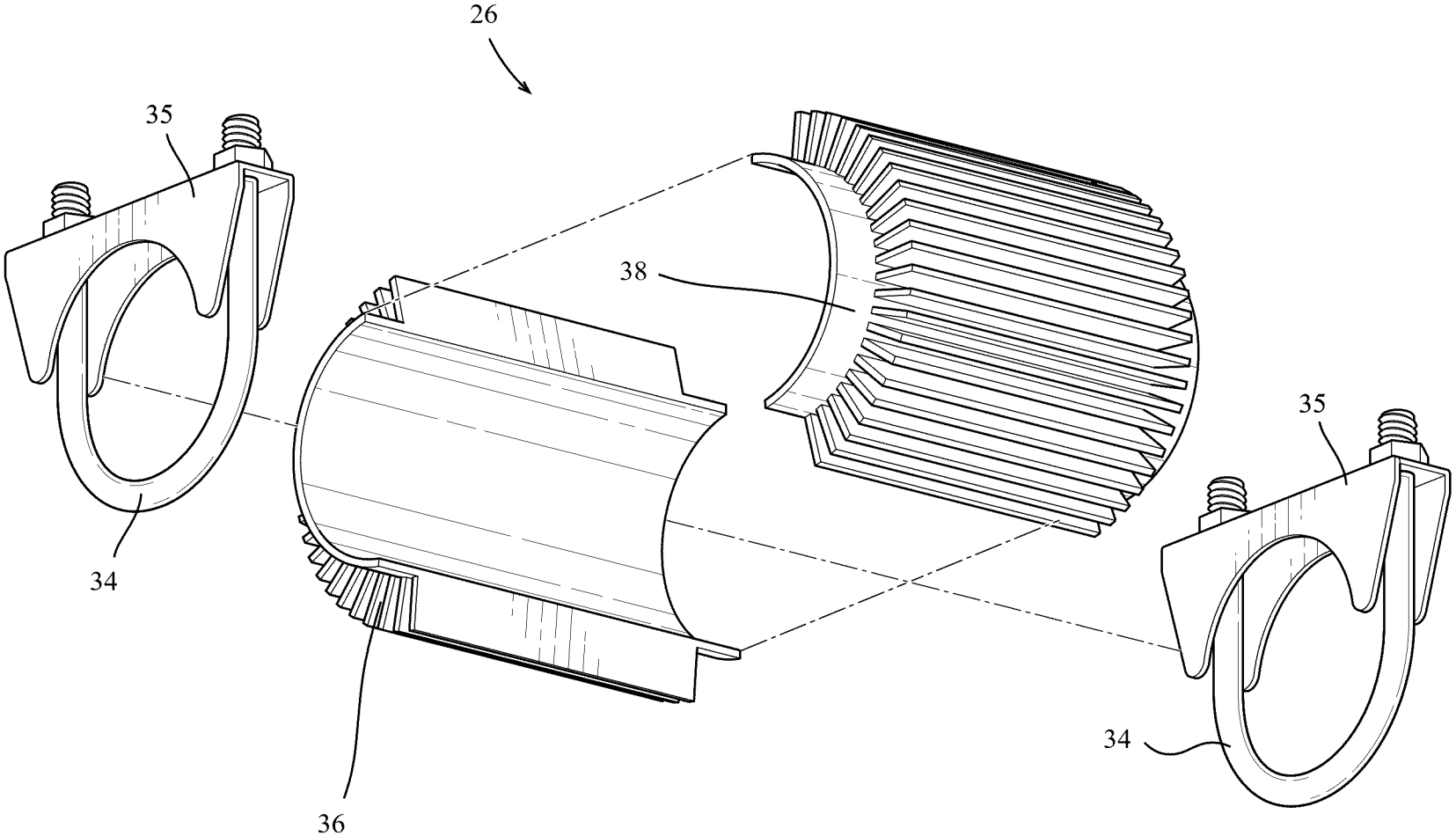
FIG. 3 is a perspective view of one embodiment of a heat sink that can be used to increase the efficiency of an internal combustion engine.
Figure 4:
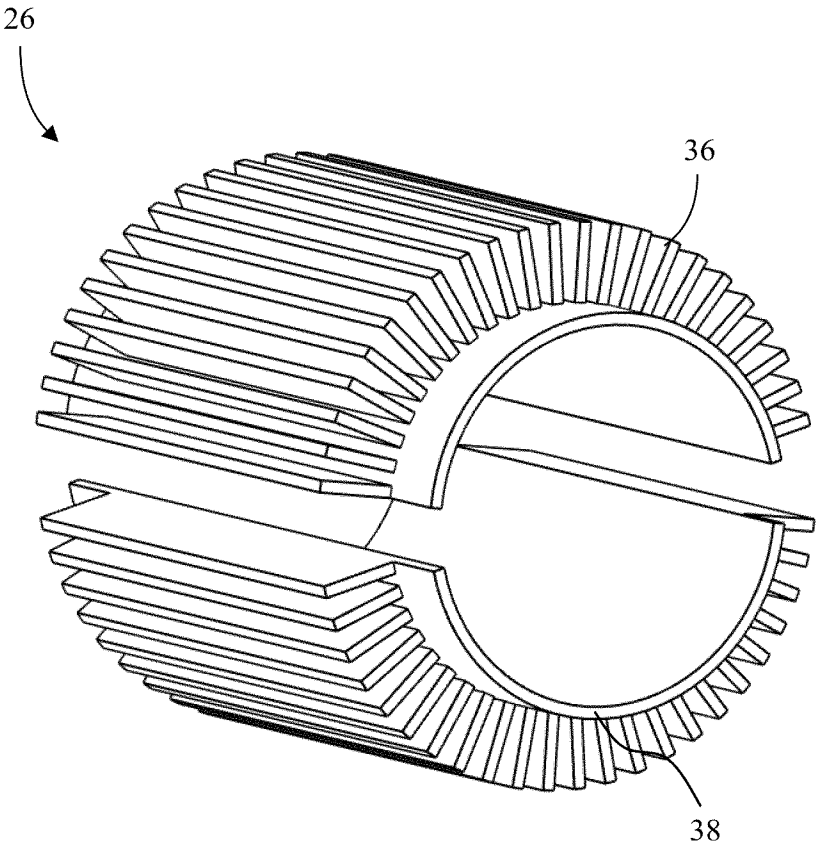
FIG. 4 is a perspective view of the heat transfer components of the heat sink shown in FIG. 3.

FIGS. 3-4 are perspective views of one embodiment of the heat sink 26. The heat sink 26 is formed of two half cylinders clamped together around the exterior of the exhaust pipe 22 with clamps 34 (e.g., bolted clamps). The clamps 34 hold the two halves of the heat sink 26 together and hold the heat sink 26 to the exhaust pipe 22.

The clamps 34 each include a bracket 35 and a U-shaped bolt having ends that extend through openings in the bracket 35. The base plates 38 each include opposing end portions over which the heat transfer fins 36 do not extend. The clamps 34 extend over the end portions of the base plates 38 to hold them against the exhaust pipe. Each bracket 35 also includes a semi-cylindrically shaped portion that corresponds to the shape of the base plates 38 so that the U-shaped bolt and the bracket 35 form a snug fit around the circumference of the end portions of the base plates 38.

It should be appreciated that the heat sink 26 can be coupled to the exhaust pipe 22 in any suitable manner. For example, the heat sink 26 can be coupled to the exhaust pipe 22 by welding, brazing, soldering, or the like. Also, the heat sink 26 can be coupled to the exhaust pipe 22 with fasteners such as bolts, screws, or the like. The heat sink 26 can be coupled to the exhaust pipe using any of the fasteners and/or fastening techniques described further down in this document. It should also be appreciated that it is preferred to couple the heat sink 26 to the exhaust pipe 22 using a releasable fascinating method or releasable fasteners.

In some embodiments, a thermal compound 40 is positioned between the heat sink 26 and the exhaust pipe 22 to increase heat transfer between the two components. The thermal compound 40 is used to eliminate air gaps or spaces (which act as thermal insulation) from the interface area to maximize heat transfer and dissipation.

The thermal compound 40 can be any suitable material. For example, in some embodiments, the thermal compound 40 includes a polymerizable liquid matrix and large volume fractions of electrically insulating, but thermally conductive filler. Typical matrix materials are epoxies, silicones (Silicone grease), urethanes, and acrylates. Aluminum oxide, boron nitride, zinc oxide, and/or aluminum nitride can be used as filler.

The heat sink 26 includes a plurality of fins 36 extending radially outward from a base plate 38. Heat is transferred from the exhaust to the wall of the exhaust pipe 22 where it is conducted to the heat sink 26. The heat is conducted from the base plate 38 of the heat sink 26 outward through the fins 36 and convectively transferred to the ambient air. The heat sink 26 includes two half cylinders each of which includes a half cylinder shaped base plate 38 with the fins 36 extending radially outward. The fins 36 extend lengthwise along a longitudinal axis of the heat sink 26.

The heat sink 26 is preferably a mechanical device that does not include any electronics. In some embodiments, it is devoid of a thermoelectric generator and/or thermoelectric generation capability. In some embodiments, the heat sink 26 has no moving parts when it is coupled to the exhaust pipe 22.

In other embodiments, the heat sink 26 can include thermoelectric materials that are configured to generate electricity. For example, a thermoelectric generator 41 can be positioned between the base plate 38 and the exhaust pipe 22. The thermoelectric generator 41 can have any suitable shape such as cylindrical shape, two half cylinder shapes, and the like. The thermoelectric materials can include n-type and p-type semiconductors connected in sequence to maximize the electrical potential and current produced by the heat sink 26. The output of the thermoelectric generator can be, at least in part, routed to a fan or pump which directly increases the volumetric flow rate of a fluid, such as air or water, through the heat sink 26 to improve heat transfer and, therefore, the efficiency of the internal combustion engine 10 even while at idle.

It should be appreciated that the heat sink 26 can be made of any suitable material. In general, it is desirable to make the heat sink 26 out of a material having a high thermal conductivity. Examples of suitable materials that can be used to make the heat sink 26 include metals such as steel, steel alloys, aluminum, aluminum alloys (e.g., aluminum 3004 alloy), titanium, or the like.

Figure 5:
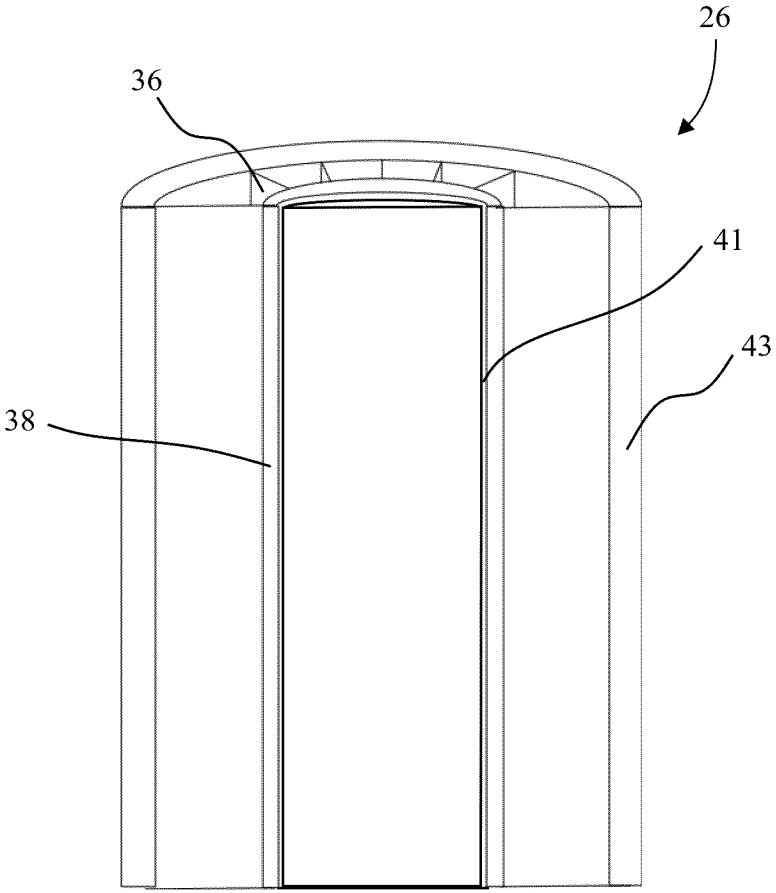
FIG. 5 is a cross-sectional view of another embodiment of a heat sink that can be used to increase the efficiency of an internal combustion engine.

FIG. 5 is a cross-sectional view of another embodiment of the heat sink 26. This embodiment is like the one shown in FIG. 3-4 except it includes an outer heat transfer plate or surface 43 connecting the outer edges of the fins 36. The ends of the heat sink 26 are open to allow airflow through and around the fins 36. It should be appreciated that the heat sink 26 can have a variety of configurations beyond those shown in the FIGS.

EXAMPLES

The following examples are provided to further illustrate the disclosed subject matter. They should not be used to constrict or limit the scope of the claims in any way.

Example 1

This example tested the effect of the heat sink 26 on fuel efficiency of class 8 semi-trucks. The heat sink 26 shown in FIG. 3 was attached to the exhaust pipe of two newish Volvo class 8 semi-trucks. Specifically, the heat sinks 26 were attached to the exhaust pipe at a location underneath the semi-truck. Two other newish Volvo class 8 semi-trucks were used as controls.

The two semi-trucks with the heat sinks 26 were driven 117,573 miles. The two semi-trucks without the heat sinks 26 were driven 147,485 miles. Each truck had two drivers that rotated and stayed with the truck.

The trucks with the heat sink 26 showed an improvement in fuel efficiency of about 5.6% to 8.2%. The average mpg for the trucks with the heat sink 26 was 9.44. The average mpg of the trucks without the heat sink 26 was 9.03.

Example 2

This example tested the effect of the heat sink 26 on fuel efficiency of a 2006 Subaru Tribeca (gasoline engine), 2020 Toyota Tacoma (gasoline engine), and a 2009 Chevy Silverado (diesel engine). The fuel efficiency of the vehicles was tracked before and after adding the heat sink 26 shown in FIG. 5 (attached to the exhaust pipe).

Figure 6:
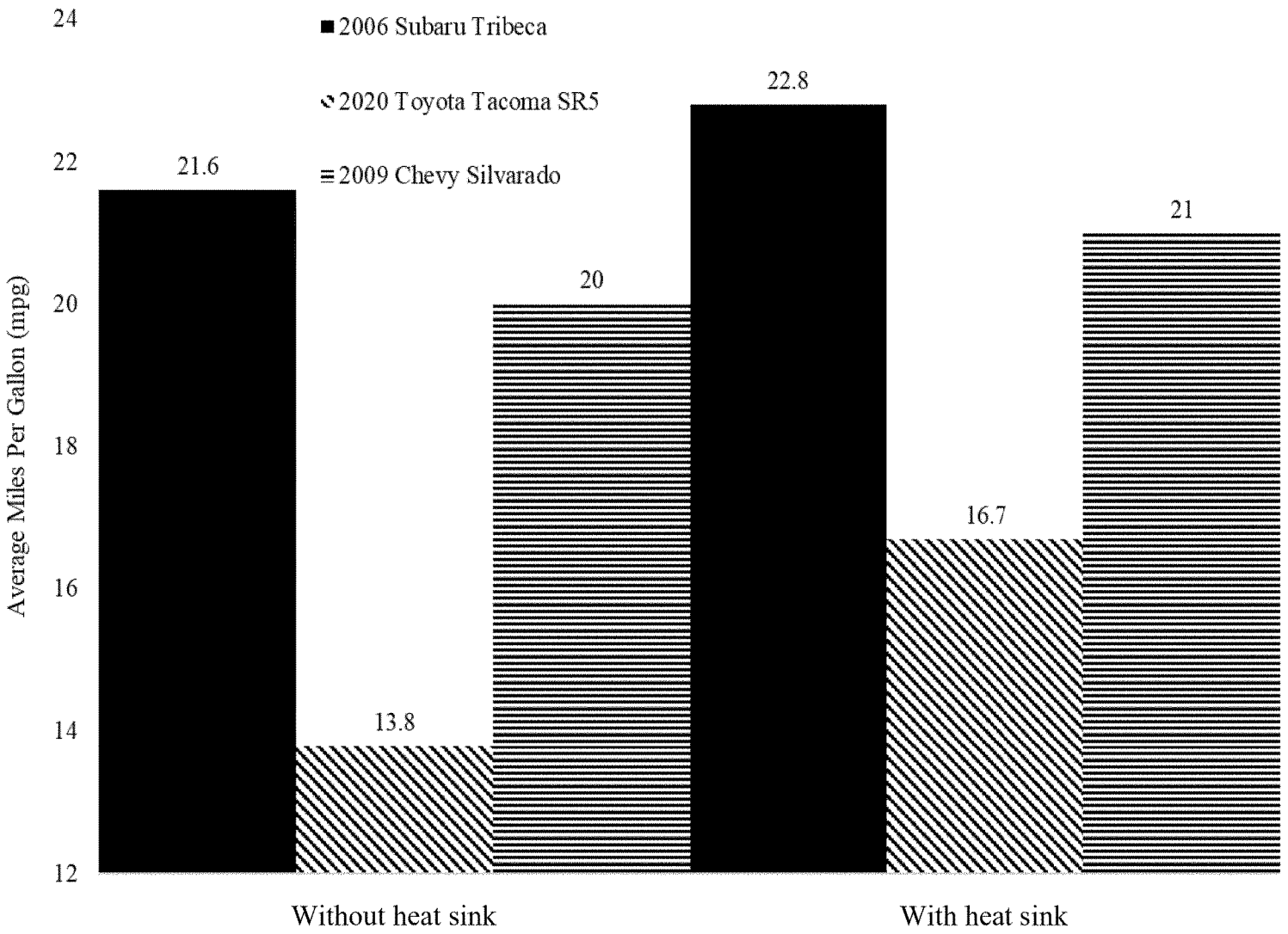
FIG. 6 is chart showing the average miles per gallon of three different vehicles that were tested with and without a heat sink on the exhaust pipe.

FIG. 6 is a chart showing the fuel efficiency of each vehicle before and after the heat sink 26 was added. In all cases, the fuel efficiency increased with the heat sink 26 attached to the exhaust pipe. The fuel efficiency of the Subaru, Toyota, and Chevy increased by 5.56%, 21.01%, and 5.00%, respectively.

This showed that the heat sink 26 is effective for both gasoline and diesel engines. Although the engines use different types of fuel, they use a Carnot cycle to convert heat to work. Lower the exhaust temperature increased the efficiency of the cycle.

ILLUSTRATIVE EMBODIMENTS

The following is a description of various embodiments of the disclosed subject matter. Each embodiment may include one or more of the various features, characteristics, or advantages of the disclosed subject matter. The embodiments are intended to illustrate a few aspects of the disclosed subject matter and should not be considered a comprehensive or exhaustive description of all possible embodiments.

P1. An internal combustion engine comprising: an engine block housing a plurality of combustion cylinders; an exhaust manifold coupled to the engine block, the exhaust manifold being fluidly linked to the combustion cylinders to receive and collect exhaust gas from the combustion cylinders; an exhaust pipe coupled to the exhaust manifold, the exhaust pipe being fluidly linked to the manifold to receive the exhaust gas from the exhaust manifold, the exhaust pipe also including a heat sink coupled to the exhaust pipe; wherein the heat sink is configured to cool the exhaust gas and increase the efficiency of the internal combustion engine; and wherein the heat sink is devoid of a thermoelectric generator and/or thermoelectric generation capability.

P2. The internal combustion engine of paragraph P1 wherein the heat sink is a passive heat exchanger that transfers heat from the exhaust pipe to ambient air.

P3. The internal combustion engine of any one of paragraphs P1-P2 wherein the heat sink includes heat transfer projections extending outward in all directions from the exhaust pipe.

P4. The internal combustion engine of paragraph P3 wherein the heat transfer projections include heat transfer fins.

P5. The internal combustion engine of any one of paragraphs P1-P4 wherein the heat sink is positioned at least four inches down the exhaust pipe from the exhaust manifold.

P6. The internal combustion engine of any one of paragraphs P1-P5 wherein the exhaust pipe includes a catalytic converter, and wherein the heat sink is positioned downstream of the catalytic converter.

P7. The internal combustion engine of any one of paragraphs P1-P6 wherein the heat sink is a separate component that is coupled to the exterior of the exhaust pipe.

P8. The internal combustion engine of any one of paragraphs P1-P7 comprising thermal compound positioned between the heat sink and the exhaust pipe.

P9. The internal combustion engine of any one of paragraphs P1-P8 wherein the heat sink is made at least in part of aluminum and/or an aluminum alloy.

P10. The internal combustion engine of any one of paragraphs P1-P9 wherein the heat sink is formed of two halves that are clamped around the exhaust pipe.

P11. An exhaust system for an internal combustion engine comprising: an exhaust manifold configured to be coupled to an engine block having a plurality of combustion cylinders, the exhaust manifold being configured to be fluidly linked to the combustion cylinders to receive and collect exhaust gas from the combustion cylinders; an exhaust pipe coupled to the exhaust manifold, the exhaust pipe being fluidly linked to the manifold to receive the exhaust gas from the exhaust manifold, the exhaust pipe also including a heat sink coupled to the exhaust pipe; wherein the heat sink is configured to cool the exhaust gas and increase the efficiency of the internal combustion engine; and wherein the heat sink is devoid of a thermoelectric generator and/or thermoelectric generation capability.

P12. The exhaust system of paragraph P11 wherein the heat sink is a passive heat exchanger that transfers heat from the exhaust pipe to ambient air.

P13. The exhaust system of any one of paragraphs P11-P12 wherein the heat sink includes heat transfer projections extending outward in all directions from the exhaust pipe.

P14. The exhaust system of paragraph P13 wherein the heat transfer projections include heat transfer fins.

P15. The exhaust system of any one of paragraphs P11-P14 wherein the heat sink is positioned at least four inches down the exhaust pipe from the exhaust manifold.

P16. The exhaust system of any one of paragraphs P11-P15 wherein the exhaust pipe includes a catalytic converter, and wherein the heat sink is positioned downstream of the catalytic converter.

P17. The exhaust system of any one of paragraphs P11-P16 wherein the heat sink is a separate component that is coupled to the exterior of the exhaust pipe.

P18. The exhaust system of any one of paragraphs P11-P17 comprising thermal compound positioned between the heat sink and the exhaust pipe.

P19. The exhaust system of any one of paragraphs P11-P18 wherein the heat sink is made at least in part of aluminum and/or an aluminum alloy.

P20. The exhaust system of any one of paragraphs P11-P19 wherein the heat sink is formed of two halves that are clamped around the exhaust pipe.

General Terminology and Interpretative Conventions

Any methods described in the claims or specification should not be interpreted to require the steps to be performed in a specific order unless expressly stated otherwise. Also, the methods should be interpreted to provide support to perform the recited steps in any order unless expressly stated otherwise.

Certain features described in the context of separate embodiments can also be implemented in combination in a single embodiment. Conversely, various features that are described in the context of a single embodiment can also be implemented in multiple embodiments separately or in any suitable subcombination. Moreover, although features may be described above in certain combinations and even initially claimed as such, one or more features from a claimed combination can be excised from the combination, and the claimed combination may be directed to a subcombination or variation of a subcombination.

The example configurations described in this document do not represent all the examples that may be implemented or that are within the scope of the claims. The term "example" shall be interpreted to mean "serving as an example, instance, or illustration," and not "preferred" or "advantageous over other examples."

Articles such as "the," "a," and "an" can connote the singular or plural. Also, the word "or" when used without a preceding "either" (or other similar language indicating that "or" is unequivocally meant to be exclusive—e.g., only one of x or y, etc.) shall be interpreted to be inclusive (e.g., "x or y" means one or both x or y).

The term "and/or" shall also be interpreted to be inclusive (e.g., "x and/or y" means one or both x or y). In situations where "and/or" or "or" are used as a conjunction for a group of three or more items, the group should be interpreted to include one item alone, all the items together, or any combination or number of the items.

The phrase "based on" shall be interpreted to refer to an open set of conditions unless unequivocally stated otherwise (e.g., based on only a given condition). For example, a step described as being based on a given condition may be based on the recited condition and one or more unrecited conditions.

The terms have, having, contain, containing, include, including, and characterized by should be interpreted to be synonymous with the terms comprise and comprising—i.e., the terms are inclusive or open-ended and do not exclude additional unrecited subject matter. The use of these terms should also be understood as disclosing and providing support for narrower alternative embodiments where these terms are replaced by "consisting of," "consisting of the recited subject matter plus impurities and/or trace amounts of other materials," or "consisting essentially of."

Unless otherwise indicated, all numbers or expressions, such as those expressing dimensions, physical characteristics, or the like, used in the specification (other than the claims) are understood to be modified in all instances by the term "approximately." At the very least, and not as an attempt to limit the application of the doctrine of equivalents to the claims, each numerical parameter recited in the specification or claims which is modified by the term "approximately" should be construed in light of the number of recited significant digits and/or by applying ordinary rounding techniques.

All disclosed ranges are to be understood to encompass and provide support for claims that recite any subranges or any individual values subsumed by each range. For example, a stated range of 1 to 10 should be considered to include and provide support for claims that recite any subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth), which values can be expressed alone or as a minimum value (e.g., at least 5.8) or a maximum value (e.g., no more than 9.9994).

All disclosed numerical values are to be understood as being variable from 0-100% in either direction and thus provide support for claims that recite such values (either alone or as a minimum or a maximum—e.g., at least <value> or no more than <value>) or any ranges or subranges that can be formed by such values. For example, a stated numerical value of 8 should be understood to vary from 0 to 16 (100% in either direction) and provide support for claims that recite the range itself (e.g., 0 to 16), any subrange within the range (e.g., 2 to 12.5) or any individual value within that range expressed individually (e.g., 15.2), as a minimum value (e.g., at least 4.3), or as a maximum value (e.g., no more than 12.4).

The terms recited in the claims should be given their ordinary and customary meaning as determined by reference to relevant entries in widely used general dictionaries and/or relevant technical dictionaries, commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used in a manner that is more expansive than its ordinary and customary meaning, the term should be given its ordinary and customary meaning plus the additional expansive meaning, or (b) if a term has been explicitly defined to have a different meaning by reciting the term followed by the phrase "as used in this document shall mean" or similar language (e.g., "this term means," "this term is defined as," "for the purposes of this disclosure this term shall mean," etc.). References to specific examples, use of "i.e.," use of the word "invention," etc., are not meant to invoke exception (b) or otherwise restrict the scope of the recited claim terms. Other than situations where exception (b) applies, nothing contained in this document should be considered a disclaimer or disavowal of claim scope.

None of the limitations in the claims should be interpreted as invoking 35 U.S.C. 112(f) unless the words "means for" or "step for" are explicitly recited in the claim.

Unless explicitly stated otherwise or otherwise apparent from context, terms such as "processing," "computing," "calculating," "determining," "displaying," or the like, refer to the action and processes of an electronic computing device including a processor and memory.

The subject matter recited in the claims is not coextensive with and should not be interpreted to be coextensive with any embodiment, feature, or combination of features described or illustrated in this document. This is true even if only a single embodiment of the feature or combination of features is illustrated and described.

Joining or Fastening Terminology and Interpretative Conventions

The term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

The term "coupled" includes joining that is permanent in nature or releasable and/or removable in nature. Permanent joining refers to joining the components together in a manner that is not capable of being reversed or returned to the original condition. Releasable joining refers to joining the components together in a manner that is capable of being reversed or returned to the original condition.

Releasable joining can be further categorized based on the difficulty of releasing the components and/or whether the components are released as part of their ordinary operation and/or use. Quickly releasable joining (i.e., quick-release) refers to joining that that can be released without the use of tools. Readily or easily releasable joining refers to joining that can be readily, easily, and/or promptly released with little or no difficulty or effort. Some joining can qualify as both quickly releasable joining and readily or easily releasable joining. Other joining can qualify as one of these types of joining but not the other. For example, one type of joining may be readily or easily releasable but also require the use of a tool.

Non-quickly releasable joining (i.e., non-quick-release) refers to joining that can only be released with the use of tools. Difficult or hard to release joining refers to joining that is difficult, hard, or arduous to release and/or requires substantial effort to release. Some joining can qualify as both non-quickly releasable joining and difficult or hard to release joining. Other joining can qualify as one of these types of joining but not the other. For example, one type of joining may require the use of a tool but may not be difficult or hard to release.

The joining can be released or intended to be released as part of the ordinary operation and/or use of the components or only in extraordinary situations and/or circumstances. In the latter case, the joining can be intended to remain joined for a long, indefinite period until the extraordinary circumstances arise.

It should be appreciated that the components can be joined together using any type of fastening method and/or fastener. The fastening method refers to the way the components are joined. A fastener is generally a separate component used in a mechanical fastening method to mechanically join the components together. A list of examples of fastening methods and/or fasteners is given below. The list is divided according to whether the fastening method and/or fastener is generally permanent, readily released, or difficult to release.

Examples of permanent fastening methods include welding, soldering, brazing, crimping, riveting, stapling, stitching, some types of nailing, some types of adhering, and some types of cementing. Examples of permanent fasteners include some types of nails, some types of dowel pins, most types of rivets, most types of staples, stitches, most types of structural ties, and toggle bolts.

Examples of readily releasable fastening methods include clamping, pinning, clipping, latching, clasping, buttoning, zipping, buckling, and tying. Examples of readily releasable fasteners include snap fasteners, retainer rings, circlips, split pin, linchpins, R-pins, clevis fasteners, cotter pins, latches, hook and loop fasteners (VELCRO), hook and eye fasteners, push pins, clips, clasps, clamps, zip ties, zippers, buttons, buckles, split pin fasteners, and/or confirmat fasteners.

Examples of difficult to release fastening methods include bolting, screwing, most types of threaded fastening, and some types of nailing. Examples of difficult to release fasteners include bolts, screws, most types of threaded fasteners, some types of nails, some types of dowel pins, a few types of rivets, a few types of structural ties.

It should be appreciated that the fastening methods and fasteners are categorized above based on their most common configurations and/or applications. The fastening methods and fasteners can fall into other categories or multiple categories depending on their specific configurations and/or applications. For example, rope, string, wire, cable, chain, or the like can be permanent, readily releasable, or difficult to release depending on the application.

Drawing Related Terminology and Interpretative Conventions

Reference numbers in the drawings and corresponding description refer to identical or similar elements although such numbers may be referenced in the context of different embodiments.

The drawings are intended to illustrate embodiments that are both drawn to scale and/or not drawn to scale. This means the drawings can be interpreted, for example, as showing: (a) everything drawn to scale, (b) nothing drawn to scale, or (c) one or more features drawn to scale and one or more features not drawn to scale. Accordingly, the drawings can serve to provide support to recite the sizes, proportions, and/or other dimensions of any of the illustrated features either alone or relative to each other. Furthermore, all such sizes, proportions, and/or other dimensions are to be understood as being variable from 0-100% in either direction and thus provide support for claims that recite such values or any ranges or subranges that can be formed by such values.

Spatial or directional terms, such as "left," "right," "front," "back," or the like, relate to the subject matter as it is shown in the drawings and/or how it is commonly oriented during manufacture, use, or the like. However, it is to be understood that the described subject matter may assume various alternative orientations and, accordingly, such terms are not to be considered as limiting.

INCORPORATION BY REFERENCE

The entire content of each document listed below is incorporated by reference into this document (the documents below are collectively referred to as the "incorporated documents"). If the same term is used in both this document and one or more of the incorporated documents, then it should be interpreted to have the broadest meaning imparted by any one or combination of these sources unless the term has been explicitly defined to have a different meaning in this document. If there is an inconsistency between any incorporated document and this document, then this document shall govern. The incorporated subject matter should not be used to limit or narrow the scope of the explicitly recited or depicted subject matter.

PRIORITY PATENT DOCUMENTS INCORPORATED BY REFERENCE

Int'l Pat. Pub. No. WO 2022/133488 (App. No. PCT/US2021/072997), titled "Exhaust System Heat Sink for Increasing Efficiency of Internal Combustion Engines," filed on 17 Dec. 2021, published on 23 Jun. 2022.

U.S. Prov. App. No. 63/126,973, titled "Carnot Cycle Heat Removal for Improved Efficiency via Thermoelectric Generation and Convection," filed on 17 Dec. 2020.

What is claimed is:

1. A heat sink comprising:

a first base plate having a cylindrical shape sized to fit around and contact an exterior surface of an exhaust pipe from an internal combustion engine;

a second base plate having a cylindrical shape sized to fit around and contact the exterior surface of the exhaust pipe from the internal combustion engine;

heat transfer fins positioned directly on and extending radially outward from the first base plate and the second base plate, the heat transfer fins extending along the first base plate and the second base plate in a direction parallel to a lengthwise direction of the heat sink; and at least two clamps configured to releasably couple the first base plate and the second base plate to the exterior surface of the exhaust pipe, each of the at least two clamps including a bracket and a U-shaped bolt having ends that extend through openings in the bracket;

wherein the first base plate and the second base plate form two halves configured to be releasably coupled around the exterior surface of the exhaust pipe;

wherein the heat sink is a passive heat exchanger configured to transfer heat from the exhaust pipe to ambient air;

wherein the first base plate and the second base plate each include opposing end portions over which the heat transfer fins do not extend; and wherein the opposing end portions are configured to receive the at least two clamps.

2. The heat sink of claim 1 wherein the heat sink is made at least in part of aluminum and/or an aluminum alloy.

3. An exhaust system for an internal combustion engine comprising:

an exhaust manifold configured to be coupled to an engine block having a plurality of combustion cylinders, the exhaust manifold being configured to be fluidly linked to the plurality of combustion cylinders to receive and collect exhaust gas from the plurality of combustion cylinders;

an exhaust pipe coupled to the exhaust manifold, the exhaust pipe being fluidly linked to the exhaust manifold to receive the exhaust gas from the exhaust manifold; and the heat sink of claim 1 coupled to the exhaust pipe.

4. The exhaust system of claim 3 wherein the heat sink is positioned at least four inches down the exhaust pipe from the exhaust manifold.

5. The exhaust system of claim 3 wherein the exhaust pipe includes a catalytic converter, and wherein the heat sink is positioned downstream of the catalytic converter.

6. An internal combustion engine comprising:

an engine block housing a plurality of combustion cylinders;

an exhaust manifold coupled to the engine block, the exhaust manifold being fluidly linked to the plurality of combustion cylinders to receive and collect exhaust gas from the plurality of combustion cylinders;

an exhaust pipe coupled to the exhaust manifold, the exhaust pipe being fluidly linked to the exhaust manifold to receive the exhaust gas from the exhaust manifold; and the heat sink of claim 1 coupled to the exhaust pipe.

7. The internal combustion engine of claim 6 wherein the heat sink is positioned at least four inches down the exhaust pipe from the exhaust manifold.

8. The internal combustion engine of claim 6 wherein the exhaust pipe includes a catalytic converter, and wherein the heat sink is positioned downstream of the catalytic converter.

9. A heat sink comprising:

a first base plate having a cylindrical shape;

a second base plate having a cylindrical shape;

one or more thermoelectric generators positioned in contact with an interior surface of the first base plate and the second base plate, the one or more thermoelectric generators being configured to fit around and contact an exterior surface of an exhaust pipe from an internal combustion engine;

heat transfer fins positioned directly on and extending radially outward from the first base plate and the second base plate, the heat transfer fins extending along the first base plate and the second base plate in a direction parallel to a lengthwise direction of the heat sink; and at least two clamps configured to releasably couple the first base plate and the second base plate to the exterior surface of the exhaust pipe, each of the at least two clamps including a bracket and a U-shaped bolt having ends that extend through openings in the bracket;

wherein the first base plate and the second base plate form two halves configured to be releasably coupled around the exterior surface of the exhaust pipe;

wherein the heat sink is a passive heat exchanger configured to transfer heat from the exhaust pipe to ambient air;

wherein the first base plate and the second base plate each include opposing end portions over which the heat transfer fins do not extend; and wherein the opposing end portions are configured to receive the at least two clamps.

10. The heat sink of claim 9 wherein the heat sink is made at least in part of aluminum and/or an aluminum alloy.

11. An exhaust system for an internal combustion engine comprising:

an exhaust manifold configured to be coupled to an engine block having a plurality of combustion cylinders, the exhaust manifold being configured to be fluidly linked to the plurality of combustion cylinders to receive and collect exhaust gas from the plurality of combustion cylinders;

an exhaust pipe coupled to the exhaust manifold, the exhaust pipe being fluidly linked to the exhaust manifold to receive the exhaust gas from the exhaust manifold; and the heat sink of claim 9 coupled to the exhaust pipe.

12. The exhaust system of claim 11 wherein the heat sink is positioned at least four inches down the exhaust pipe from the exhaust manifold.

13. The exhaust system of claim 11 wherein the exhaust pipe includes a catalytic converter, and wherein the heat sink is positioned downstream of the catalytic converter.

14. An internal combustion engine comprising:

an engine block housing a plurality of combustion cylinders;

an exhaust manifold coupled to the engine block, the exhaust manifold being fluidly linked to the plurality of combustion cylinders to receive and collect exhaust gas from the plurality of combustion cylinders;

an exhaust pipe coupled to the exhaust manifold, the exhaust pipe being fluidly linked to the exhaust manifold to receive the exhaust gas from the exhaust manifold; and the heat sink of claim 9 coupled to the exhaust pipe.

15. The internal combustion engine of claim 14 wherein the heat sink is positioned at least four inches down the exhaust pipe from the exhaust manifold.

16. The internal combustion engine of claim 14 wherein the exhaust pipe includes a catalytic converter, and wherein the heat sink is positioned downstream of the catalytic converter.

* * * * *